US006229260B1

(12) United States Patent
Haitko et al.

(10) Patent No.: US 6,229,260 B1
(45) **Date of Patent: *May 8, 2001**

(54) CONTROL OF LEACHABLE MERCURY IN FLUORESCENT LAMPS

(75) Inventors: Deborah Ann Haitko, Schenectady; Donald Franklin Foust, Scotia; David Key Dietrich, Schenectady; Ora Marie Henkes, Latham, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/200,561

(22) Filed: Nov. 27, 1998

(51) Int. Cl.[7] ..... H01J 17/24

(52) U.S. Cl. ..... 313/565; 313/318.01; 313/490; 445/2

(58) Field of Search ..... 313/565, 318.01, 313/639, 490; 445/2, 61

(56) References Cited

U.S. PATENT DOCUMENTS

| | | | | |
|---|---|---|---|---|
| 5,229,686 | | 7/1993 | Fowler et al. . | |
| 5,229,687 | | 7/1993 | Fowler et al. . | |
| 5,754,002 | | 5/1998 | Haitko et al. . | |
| 5,898,265 | * | 4/1999 | Woodward et al. | 313/486 |

* cited by examiner

*Primary Examiner*—Ashok Patel
*Assistant Examiner*—Karabi Guharay
(74) *Attorney, Agent, or Firm*—Bernadette M. Bennett; Noreen C. Johnson

(57) ABSTRACT

The formation of leachable mercury upon disposal in a landfill or during TCLP testing of mercury vapor discharge lamps is substantially prevented by incorporation of an amount of dehydroascorbic acid or a degradation product of dehydroascorbic acid which is effective to substantially prevent formation of ferric and cuprous compounds responsible for forming leachable mercury compounds.

6 Claims, No Drawings

CONTROL OF LEACHABLE MERCURY IN FLUORESCENT LAMPS

BACKGROUND OF THE INVENTION

This invention is directed broadly to mercury vapor arc discharge lamps and more particularly to methods for avoidance of soluble mercury pollution of landfills and groundwater upon disposal of such lamps and during TCLP testing for leaching of soluble mercury materials from such lamps. Compositions of matter useful in preventing the formation of leachable mercury in disposal and testing procedures form a part of the invention.

Low pressure mercury arc discharge lamps are standard lighting means which include electrodes sealed in a glass envelope, the interior of which may be coated with a phosphor. The lamp also contains a small amount of mercury and an inert gas at low pressure, of about 1 to 5 torr. The term lamp, as used herein, means the complete unit including the glass envelope and the end pieces and plugs for mounting in a lamp fixture, and wires which connect the internal components of the envelope with the end pieces.

During manufacture of fluorescent or low pressure mercury arc lamps an amount of elemental mercury ($Hg^0$) is sealed in the lamp envelope. Most of the mercury adheres to the phosphor coating, a small amount being in the vapor phase.

During operation, alkali metal carbonates from the electrodes decompose and form free oxygen in the lamp. The oxygen may react with a portion of the mercury to form soluble mercury oxide (HgO). Soluble mercury oxide is leachable from land fills and other disposal facilities. Soluble mercury oxides or other oxidized forms of mercury formed in the course of the test are detrimental to the accuracy and reliability of the standard test for determination of the leachability of toxic materials from lamp waste. This test is generally referred to as the Toxicity Leaching Characteristic Procedure or TLCP test.

There is concern about the environmental impact of soluble mercury compounds which can leach into ground water sources, rivers, streams, and the like. The lamps provided by this invention are characterized by low levels of leachable mercury when the lamp is pulverized for testing or upon disposal in a landfill.

In the prior art, certain oxidants and reductants are placed in a lamp to alter the form of mercury in the course of the TCLP test. These agents function to remove leachable mercury from the TCLP solution. The method of the instant invention prevents formation of leachable mercury and also reduce any leached or soluble mercury to insoluble elemental mercury. The dehydroascorbic acid antioxidant of this invention prevents oxidation of iron and copper, thereby preventing formation of leachable mercury, and also reduces oxidized or soluble mercury. This later capability lessens mercury contamination within a landfill. Reduction of soluble mercury to insoluble elemental mercury also provides a method for recovery of mercury from contaminated soil and water.

SUMMARY OF THE INVENTION

Ferric and cuprous ions form soluble compounds which are capable of oxidizing elemental mercury to the monovalent, mercurous, form which is soluble in an acidic aqueous environment and therefore leachable. The formation of ferric and cuprous compounds depend on exposure to and reaction with oxygen. Dehydroascorbic acid incorporated in the lamp prevents formation of ferric and cuprous compounds, in the presence of water or moisture, by oxidation of iron and copper from lamp components, thereby greatly reducing or substantially preventing the formation of leachable mercurous and mercuric compounds by oxidation of elemental mercury.

In the course of performing the Toxicity Leaching Characteristic Procedure, TCLP, upon manually dosed (10 mg of elemental Hg added to an undosed lamp) T12 fluorescent lamps it was found that leachable mercury was generated. The metal components of the lamp, specifically the iron lead wires, copper coated leads, and brass pins generate $Fe^{+3}$ and $Cu^{+1}$ are both capable of oxidizing elemental Hg to $Hg^{+1}$ in the TCLP extractant solution.

If one performs the TCLP extraction upon the rest of the lamp once the metal components have been removed the leachable mercury values are significantly decreased. The dissolution of $Fe^{+3}$ and $Cu^{+1}$ in the TCLP extraction depend upon the presence of oxygen for the corrosion process to occur. By addition of antioxidants within the test, the amount of soluble $Fe^{+3}$ and $Cu^{+1}$ is decreased and, concomitantly, the amount of mercury that leaches from the extraction is also significantly reduced. Metal reductants have been employed that prevent the dissolution of $Fe^{+3}$ and $Cu^{+1}$ so that the oxidation of $Hg^0$ is greatly diminished. The antioxidants also are capable of removing leachable mercury from solution so that benefit is obtained to pass the TCLP test and to the environment if lamps are disposed within a landfill. The antioxidant that has proven to be effective and capable of manufacture within the lamp design is ascorbic acid. It has been found that ascorbic acid can oxidize to dehydroascorbic acid under lamp manufacturing conditions. Dehydroascorbic acid and some of its degradation products are effective as an anti-oxidants in TCLP testing of fluorescent lamps. Some of the degradation products included are the following: 2,3-dioxo-L-gulonic acid, oxalic acid, L-threoic acid, ([R-(R*,S*)]-2,3,4-trihydroxybutanoic acid), tartaric acid, furfural, 2-furoic acid, ethylglyoxal, furoin, and 2-methyl-3,8-hydroxychroman.

The invention provides a mercury vapor discharge lamp comprising an envelope of light transmitting glass which contains, an inert gas and an amount of elemental mercury, a pair of electrodes for establishing an arc discharge, and an effective amount of an antioxidant.

Fluorescent lamps generally include at least one base or end cap which defines a cavity having an inner surface. The cap is secured to the glass lamp envelope by a basing cement. The dehydroascorbic acid reagent can be conveniently admixed with the basing cement and incorporated into the lamp accordingly. Generally, fluorescent lamps of the tube type have a pair of end caps.

The dehydroascorbic acid is admixed with the basing cement used to secure the end caps in place on the glass envelope or can be placed in the end cap as an adhesive composition which does not function as a cement for the caps.

The invention, accordingly, includes dehydroascorbic acid admixed with an inert water soluble adhesive binder composition which can be included in the lamp structure for the purpose of controlling oxidation of iron and copper in order to minimize or prevent formation of soluble mercury compounds. The composition functions by reducing or preventing formation of water soluble leachable mercury compounds in landfills or TLCP test samples.

DESCRIPTION OF THE INVENTION

The incorporation of dehydroascorbic acid in a lamp prevents oxidation of iron and copper metal components to a form which is both soluble and capable of oxidizing elemental mercury to a soluble form of mercury oxide. Accordingly the formation and dissolution of soluble ferric and cuprous compounds from the lamp components is diminished or prevented resulting in reduction of leachable mercury compounds.

The formation of leachable mercury when fluorescent lamps are broken and exposed to landfill conditions can be prevented or minimized by preventing oxidation of certain components of the lamp. Certain metal components of fluorescent lamps particularly iron lead wires, copper coated leads, and any brass components generate ferric ($Fe^{+3}$) and cuprous ($Cu^{+1}$) ions when exposed to moisture, oxygen, and acidity.

In order to address the growing concern that excessive amounts of mercury from disposal of fluorescent lamps might leach into surface and subsurface bodies of water, the Environmental Protection Agency has established a maximum concentration level for mercury at 0.2 milligrams of leachable mercury per liter. This is generally determined by the standard analysis known as the Toxicity Characteristic Leaching Procedure (TCLP), a well known test procedure.

In carrying out the TCLP test, the lamps are pulverized to form lamp waste material similar to that which would result from lamp disposal in land fills or other disposal locations. The ambient conditions in such locations may be such as to promote formation of leachable mercury just as the TCLP test conditions themselves tend to allow for formation of leachable mercury in amounts greater than the established limit of 0.2 milligrams per liter.

It has been found that elemental mercury added to mercury-free pulverized lamp materials prepared for the TCLP test is converted to leachable mercury in the course of the test. If elemental mercury alone or in combination with various glass, phosphor, or non-metal lamp components is tested, little or essentially no leachable mercury is found. When elemental mercury is tested in combination with metal lamp components such as copper or iron, lead wires, pins, or other metal hardware, the mercury is transformed into a leachable form.

It was determined by controlled experimentation that both ferric iron (trivalent) and cuprous (monovalent) copper are generated under the TCLP test conditions when carried out in the presence of oxygen and that these ionic species are able to oxidize elemental mercury to soluble mercury compounds which are measured as leachable mercury.

Corrosion or dissolution of metals from the metallic state requires the presence of both oxygen and a solvent such as water conditions that exist in the TCLP test and landfill situations. Accordingly, it has been found that the formation can be controlled or prevented by controlling or excluding exposure to oxygen of the iron and copper-containing metal lamp components. This can be done by the use of oxygen-free or anaerobic test and disposal conditions.

Organic or inorganic antioxidants incorporated into fluorescent lamps during manufacture become operative in the course of preparing lamps for the TCLP test or upon destruction of the lamp during disposal. The presence of such antioxidants will make the TCLP test more accurate and reliable and will reduce the formation of soluble mercury compounds when the lamps are disposed of.

The principles and practice of this invention will be more fully understood when considered in view of the following examples.

TCLP test data was obtained by the test procedure prescribed on pages 26987–26998 volume 55, number 126 of the Jun. 29, 1990 issue of the Federal Register.

Briefly, lamps being tested are pulverized into particulate form having the prescribed particle size which is capable of passing through ⅜ inch sieve. The test material is then extracted with a sodium acetate-acetic acid buffer at a pH of about 4.93.

To prevent the spurious formation of leachable mercury upon disposal of mercury vapor discharge lamps and to improve the reliability of the TCLP test an effective amount of an antioxidant is incorporated in the lamp structure, for example within the glass envelope exterior to the plasma discharge or in an end-cap, or in the base of the lamp. An effective amount of the antioxidant is that amount which will substantially prevent formation of ferric and cuprous compounds which can oxidize elemental mercury to a soluble form. In general, an effective amount of the antioxidant will be enough for the TCLP test results to show the presence of less than about 0.2 parts per million of leachable mercury. Typically, the amount of dehydroascorbic acid incorporated in the lamp is in a range between about 0.02 grams and about 3 grams per lamp.

The formation of soluble mercury compounds is illustrated by the data in Table 1, below. Carrying out the TCLP test in the presence of air generates about 1 part per million of copper and about 0.3 parts per million of soluble iron. The amount of soluble mercury formed under these conditions exceeds the regulatory limit of 0.2 parts per million. Increasing the exposure to oxygen increases the amount of soluble copper and soluble mercury formed. Decreasing exposure to oxygen decreases the formation of soluble copper, soluble iron, and soluble mercury

TABLE 1

| Gas Type | Soluble Cu ppm | Soluble Hg ppm |
|---|---|---|
| Air | 1.07 | 0.777 |
| Argon | 0.06 | <0.050 |
| Oxygen | 3.04 | 1.030 |

When the amount of oxygen is varied by increasing the volume of the head space in the TCLP test jar, the effect of both soluble iron and copper on the formation of soluble mercury is evident from the data in Table 2, below. As the head space volume increases, the amount of soluble mercury increases in response to the formation of increasing amounts of soluble copper and iron.

TABLE 2

| | Head Space (mL) | Soluble Mercury (ppb) | Soluble Iron (ppm) | Soluble Copper (ppm) |
|---|---|---|---|---|
| 0 | 0.0000 | 210 | 3.62 | 0.35 |
| 1 | 140 | 214 | 4.63 | 0.40 |
| 2 | 205 | 203 | 5.04 | 0.63 |
| 3 | 360 | 250 | 5.22 | 0.43 |
| 4 | 494 | 311 | 5.22 | 0.51 |
| 5 | 763 | 525 | 6.13 | 1.04 |
| 6 | 1013 | 458 | 5.80 | 1.02 |
| 7 | 1508 | 583 | 8.12 | 1.13 |

Since finding that elemental mercury added to undosed lamps generates leachable mercury in the TCLP test, we have been developing an understanding of why mercury leaches under these conditions. If one tests elemental mercury alone or in combination with the glass or phosphor (from an undosed fluorescent lamp) under TCLP conditions, no mercury leaches. It is only when elemental mercury comes in contact of the metal components in the lamp such as the copper and iron containing lead wires, brass pins, or other associated metallic hardware that transform mercury into a leachable form. It was determined by control experiments that both $Fe^{+3}$ and $Cu^{+1}$ are capable of generating oxidized forms of mercury that are leachable under TCLP conditions. It is known that corrosion or dissolution of metals from the metallic state requires both oxygen and water—both present under TCLP conditions. When dehydroascorbic acid is used under TCLP conditions, dissolution or oxidation of metals like iron and copper is decreased. Table 3, below, shows the effect of performing the TCLP extraction upon manually dosed fluorescent lamps in the presence of 0.2, 0.4, and 0.5 grams of dehydroascorbic acid per lamp and the effect upon leachable mercury values as the amount of mercury is increased.

TABLE 3

| Hg Dose (mg) per Lamp | Leachable Hg (As Is) | 0.5 gram Dehydro per F40T12CW/WM | 0.2 gm Dehydro per F96T12CW/WM | 0.4 gm Dehydro per F96T12CW/WM |
|---|---|---|---|---|
| 0 | 0 | 0 | 0 | 0 |
| 4.6 | — | — | — | 42 |
| 5 | 53 | 49 | — | — |
| 6.1 | — | — | 64 | — |
| 10 | 107 | 65 | 86 | 56 |
| 15 | 188 | 81 | — | — |
| 20 | 586 | 82 | 67 | 56 |
| 30 | 945 | — | 123 | 37 |
| 40 | 1140 | 144 | 116 | 75 |

Dehydroascorbic acid can also be generated during a lamp assembly process by incorporating an equivalent amount of ascorbic acid and heating under relatively mild conditions. Mild heat is generally used to cure or set the basing cement. Gas chromatography coupled with mass spectroscopy experiments have confirmed that dehydroascorbic acid can be generated by heating ascorbic acid. The end capping procedure in fluorescent lamp manufacture can reach temperatures that favor conversion of ascorbic acid to dehydroascorbic acid.

The antioxidant material can also be incorporated in the basing cement of the lamp that holds the aluminum cap to the leaded glass portion of the end of the lamp. The basing cement generally comprises about 80 weight % marble flour (limestone-CaO), and the balance shellac a phenolic resin binder, a solvent for blending, and a dye used to color the cement. The cement is dispensed through a feeder into the base and heated to cure once assembled with the lamp. The curing drives off the solvent and solidifies the cement. The antioxidant is blended with the cement components and incorporated in a lamp manually or by automated manufacturing equipment. The antioxidant material is released only when the lamp is destroyed or crushed in preparation for TCLP testing. In this method the active antioxidant material is always exterior to the positive column of the lamp.

Another method for incorporating the active antioxidant material in the lamp structure is to admix it with an inert water soluble adhesive carrier or binder. Gums and gelatins have been used as such adhesives and binders. The nature of the gums and gelatins is that they adhere to surfaces when heated. The composition containing the antioxidant material can be placed on the inner surface of the aluminum end cap as a ring or discrete button. When the lamp is crushed and exposed to an aqueous environment or placed in the TCLP solution, the water soluble binder allows the antioxidant to be released quickly.

What is claimed is:

1. A method for preventing formation of leachable mercury compounds during TCLP testing of mercury vapor discharge lamps having an envelope of light transmitting glass and an amount of elemental mercury which comprises incorporating into the lamp structure an amount of dehydroascorbic acid or a degradation product of dehydroascorbic acid which is effective to substantially prevent formation of ferric and cuprous compounds when iron and copper components of the lamp are exposed to moisture and acidic conditions.

2. The method of claim 1 wherein the dehydroascorbic acid is incorporated in the lamp in an amount of about 0.02 to about 3 grams per lamp.

3. The method according to claim 1 for preventing the formation of leachable mercury compounds in mercury vapor discharge lamps which comprises incorporation into the lamp structure of amount of dehydroascorbic acid as a component of the basing cement.

4. A method for preventing formation of leachable mercury compounds in mercury vapor discharge lamps comprising incorporating into the lamp structure an amount of dehydroascorbic acid or a degradation product of dehydroascorbic acid which is effective to substantially prevent the formation of ferric and cuprous compounds when iron and copper components of the lamp are exposed to moisture and acidic conditions.

5. The method according to claim 4, wherein the dehydroascorbic acid is incorporated in the lamp in an amount in a range between about 0.02 grams and about 3 grams per lamp.

6. The method according to claim 4 wherein the dehydroascorbic acid is incorporated into the lamp structure as a component of basing cement.

* * * * *